United States Patent [19]

Darling

[11] Patent Number: 5,054,008

[45] Date of Patent: Oct. 1, 1991

[54] WORLD TIME DEVICE

[76] Inventor: Dwight Darling, R.R. No. 1, Brockville, Ontario, Canada, K6V 5T1

[21] Appl. No.: 421,989

[22] Filed: Oct. 16, 1989

[51] Int. Cl.[5] ..... G04B 19/22

[52] U.S. Cl. ..... 368/27; 368/21

[58] Field of Search ..... 368/27, 21, 22

[56] References Cited

U.S. PATENT DOCUMENTS

| | | | |
|---|---|---|---|
| 557,173 | 3/1896 | Thompson | 368/27 |
| 594,410 | 11/1897 | Margolis . | |
| 718,579 | 3/1903 | Pheils | 368/27 |
| 2,128,970 | 9/1938 | Smyser et al. | 368/27 |
| 2,615,298 | 10/1952 | Ferrari | 368/27 |
| 4,502,789 | 3/1985 | Heath | 368/27 |

*Primary Examiner*—Bernard Roskowski

*Attorney, Agent, or Firm*—Sughrue, Mion, Zinn Macpeak & Seas

[57] ABSTRACT

A device for determining the time anywhere in the world, simultaneously, relative to any selected geographical location. A circuit map is positioned over a frame and is rotatable in a clockwise direction relative to the frame, the map being a south pole projection of the world. The map rotates about the center point of the map corresponding to the south pole. Twenty-four evenly spaced first time zone positions are provided on the frame beyond the outer boundary of the map and together they define a circle which is outwardly concentric with the map. Twenty-four evenly spaced second time zone positions are provided on and around the perimeter of the map so as to define a second circle between and concentric with the circle defined by the first time zone positions and the map. Each first and second time zone position corresponds to a distint hour of a twenty-four-hour time period. Land areas of the map and their associated second time zone positions are visually coded (for example, color coded) to correspond to distinct time zones. To operate the device the map is rotated in a clockwise direction to align the second time zone position associated with a pre-selected land area with the corresponding first time zone position and, by associating first and second time zone positions and corresponding land areas by means of the visual coding, an identification is made of the distinct hour relative to the pre-selected land area which corresponds to a selected land area.

5 Claims, 1 Drawing Sheet

WORLD TIME DEVICE

FIELD OF THE INVENTION

A device for determining the time at any geographical location in the world relative to a pre-selected location. The device may be combined with a twenty-four hour clock mechanism for automated operation.

BACKGROUND

Many devices and calculation means for determining the time in different time zones of the world have been used in the past. However, all such prior means have required some form of calculation, or skilled operation, on the part of the user or a high degree of knowledge of, and familiarity with, the subject of world geography.

U.S. Pat. No. 594,410 to Margolis describes one such device comprising two overlapping maps which together rotate by means of the operation of a twenty-four-hour clock mechanism, one map being of the southern hemisphere and the other of the northern hemisphere. However, a high degree of visual confusion is caused by the use of such overlapping maps and it is difficult to identify the position of selected cities, or even countries, on such a combination of maps. Moreover, the Margolis patent does not provide a visual coding means whereby land areas falling within different time zones may be readily distinguished. The Margolis reference further does not readily lend itself to the marking of city and country names on the maps themselves because of the fact of there being two overlapping maps and, therefore, several areas having too many associated names to mark on the limited area provided.

SUMMARY OF THE INVENTION

The invention claimed herein provides a device for determining the time of day anywhere in the world, and the device does not have associated with it the above-identified disadvantages of the prior art. The device may be manually operable or may instead be automated in the form of a clock. Essentially, the device comprises a frame, a rotatable map positioned thereover, twenty-four evenly spaced first time zone positions on the frame and together defining a first circle which is outwardly concentric with the map and twenty-four evenly spaced second time zone positions around the perimeter of the map and together defining a second circle between and concentric with the first circle and the map. The map is a south pole projection of the world and rotates in a clockwise direction relative to the frame such that rotation occurs about the center point of the map corresponding to the south pole. Each of the first and second time zone positions on the frame corresponds to a distinct hour of a consecutive twenty-four-hour time period. Land areas of the map and their associated second time zone positions are visually coded so as to correspond to distinct time zones. The map may be rotated in a clockwise direction to align the second time zone position associated with a pre-selected land area with the corresponding first time zone position to identify from the device, by associating first and second time zone positions and corresponding land areas by means of the visual coding, the distinct hour of the twenty-four hours which corresponds to a selected land area.

In a preferred embodiment of the invention, the operation of the device is automated by means of a twenty-four-hour clock mechanism, the hour hand of the clock mechanism being fixed to the map so that the map is caused to rotate by and with the hour hand. Preferably, the device, whether manually operable or in the form of a clock, includes additional visual coding means associated with land areas of the map which are in half-hour time zones.

DETAILED DESCRIPTION OF AN EMBODIMENT OF THE INVENTION

Figure 1:
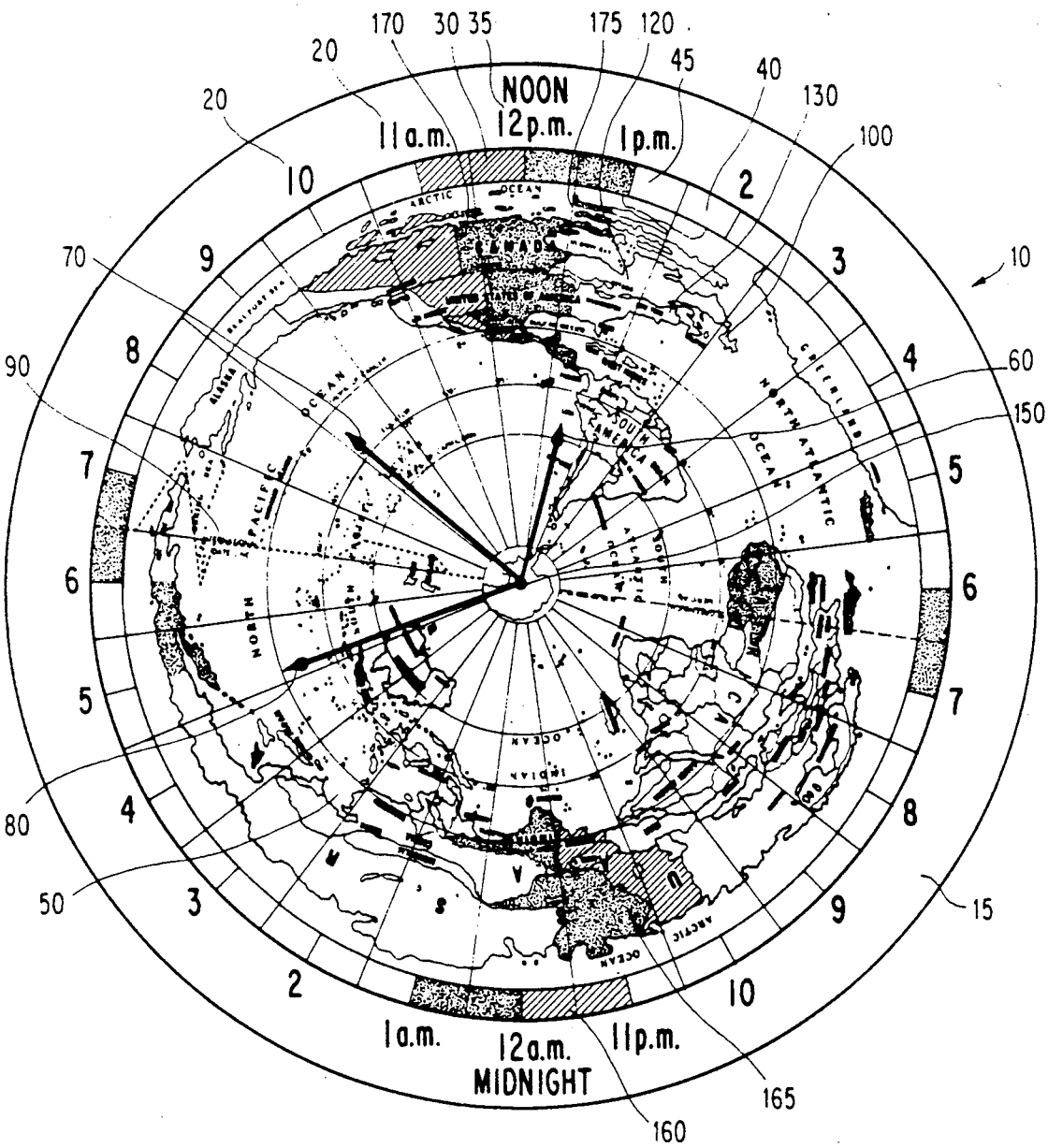
FIG. 1 illustrates a world time clock device embodying the invention.

The invention is described in detail in the following with reference to FIG. 1. Reference numerals referred to hereinafter refer to the reference numerals appearing in FIG. 1 to identify elements of the device illustrated thereby. The embodiment of the invention of FIG. 1 is selected for purposes of illustration only; it is to be understood by the reader that other embodiments might instead be selected if desired, for example, an embodiment which is manually operable.

Referring to FIG. 1, a world time clock device 10 is shown having a frame 15, a rotatable map 50 positioned thereover, twenty-four first time zone positions 20, 35 evenly spaced around said frame 15 and beyond the outer boundary of the map 50 so as to define a circle thereon, and twenty-four evenly spaced second time zone positions 30, 40, 45, 160 on and around the perimeter of the map 50 and together defining a second circle between and concentric with the circle defined by the first time zone positions and the map 50.

The map 50 is a south pole projection of the world and rotates in a clockwise direction about the center point 150 of the map which corresponds to the south pole. A conventional twenty-four-hour clock mechanism (not shown) is installed below the map 50 and within the frame 15, the clock mechanism comprising an hour hand 60, a minute hand 70 and a second hand 80. The hour hand 60 is fixed to the rotatable map 50 so that the automated rotation of the hour hand 60 (via the conventional battery-operated clock mechanism) causes the map 50 to rotate with the hour hand 60 as the hour hand 60 rotates. A full circular rotation of the hour hand 60, and therefore the map 50, occurs once every twenty-four-hour period. (A north pole projection map is not suitable as the device could not then use a conventional clock mechanism which operates in a clockwise direction; rather a counter-clockwise rotation of the map would be required. A further disadvantage associated with a north pole projection map would be a high concentration of land around the center of the map.)

The twenty-four first time zone positions (e.g. 20) are marked to identify the hours of a single twenty-four-hour time period from 12 a.m. to 11 p.m. For clarity and improved readability, these hourly markings also include the marking "NOON" in association with the time zone position marked 12 p.m. and "MIDNIGHT" in association with the 12 a.m. time zone position. Each time zone position (20) corresponds to a distinct hour of a twenty-four-hour time period and, therefore, the hour hand 60 passes by a first time zone position (20) every hour. The minute hand 70 rotates once every hour (the same as for conventional twelve hour clocks) and, therefore, passes by a first time zone position (20) every two and a half minutes. Similar to the operation of the minute hand 70, the second hand 80 passes by a first time zone position (20) every two and a half seconds. Accordingly, the time of the day indicated by the clock hands 60, 70, 80 shown in FIG. 1 is 12:51:41 p.m. This is the time for all land areas corresponding to first time zone position 30.

Because the map 50 is a single south pole projection map of the world, portraying all land areas of the world in a single plane relative to the south pole, the longitudinal lines (e.g. 170, 175) do not identify or distinguish different time zones of the land areas shown on the map. Rather, the different time zones corresponding to land areas of the map 50 are visually distinguished by means of colour coding. For example, with reference to FIG. 1, the colour coding selected for the land area comprising the Canadian province of Manitoba, the United States state of Minnesota downwards through to Louisiana, Mexico and Central America is red (shown in FIG. 1 by dark shading) and, as can be seen from the map 50, this area crosses over the longitudinal lines 170, 175. The second time zone position 30 is also colour-coded with the colour red such that all land areas which are colour-coded with the colour red correspond to the red colour-coded second time zone position 30. In turn, the second time zone position 30 is aligned with, and corresponds to, the first time zone position 35 representing, in FIG. 1, 12 p.m. In any given quadrant of the map 50, the colour selected for the visual coding of land areas within the same time zone is not duplicated, to avoid confusion in identifying land areas within distinct time zones, but may be duplicated in the opposite quadrant without risk of confusion. Thus, in the embodiment of FIG. 1, it was elected to also use the colour red for the second time zone position 160 and its associated land areas 165 falling within the time zone 12 a.m.

To set the device 10 for use in the particular geographical area in which the user is located, the hour hand 60 is positioned so as to align with the first time zone position which corresponds to the closest hour of that geographical area and the minute and second hands are aligned with the first time zone positions corresponding to the minute and second of that area (bearing in mind that each first time zone position corresponds only to two and a half minutes or seconds, respectively). Referring to FIG. 1, the device 10 is set for use in the preselected geographical land area comprising Ottawa, Canada and the hour hand 60 is approaching the first time zone position marked "1 p.m.". The device identifies the time in Ottawa, Canada as being 12:51:41 p.m. (approaching 1 p.m.). The same time applies to all other land areas having the same colour coding as the second time zone position 45 (which is aligned with the 1 p.m. first time zone marking) for example, New York City 130.

To determine the time in any other selected geographical land area, outside of the time zone comprising the land areas which are colour-coded to correspond to the 1 p.m. first time zone position marking shown in FIG. 1, one identifies the colour associated with that land area, the second time zone position nearest that area which corresponds to that colour and the corresponding first time zone position located above that second time zone position. For example, with reference to FIG. 1, it may be seen that when the time in Ottawa, Canada is 12:51:41 p.m., the time in Mexico is one hour earlier, that is, 11:51:41 a.m. Simultaneously, the time in all other land areas of the map, relative to the preselected land area (being Ottawa in the foregoing example) may be determined according to the foregoing procedure.

To account for land areas which are situated in half hour time zones, a different visual coding means is used to identify such areas. In the embodiment of FIG. 1, vertical lines are used to indicate an area for which the time is one-half hour prior to the neighbouring land areas having the same colour code. In FIG. 1, therefore, Newfoundland, Canada is colour-coded to be the same colour as Greenland and is also coded by vertical lines 100 to identify that the time in Newfoundland is one-half hour prior to that in Greenland.

The International Date Line 90 marks the date applicable to the geographical areas of the map 50. To illustrate this with reference to FIG. 1, it is shown that Alaska corresponds to the 8 a.m. first time zone position marking and that New Zealand corresponds to the 6 a.m. first time zone position marking. If the date is 1 January in Ottawa, Canada, the date in Alaska is also 1 January but 2 January in New Zealand. Since the a.m. hour applicable to New Zealand falls on the opposite side of the International Date Line relative to Alaska, as well as the first time zone position markings 1 a.m. to 6 a.m., all of these positions pertain to the day following that of Ottawa, Canada.

While the foregoing specific description is directed to the embodiment shown in FIG. 1, the invention is not limited to the described embodiment. Many variations of the specific features described above might be made while still falling within the scope of the invention. For example, as stated previously, the clock mechanism need not be included if, say, a manually operable pocket device, according to the invention, were to be instead desired. In the case of a hand-operated device, the user may prefer to rotate the frame in counter-clockwise direction relative to the map to set the time zone positions for a pre-selected land area, rather than to rotate the map, the two manners of operation being equivalent.

The embodiments of the invention in which an exclusive property or privilege is claimed are defined as follows:

1. A device for determining the time in any location in the world relative to a selected geographical area, said device comprising:

(i) a frame;

(ii) a circular world map positioned over said frame and rotatable relative to said frame, wherein said world map which includes a modified south pole projection of the world rotates about the center point of said map corresponding to the south pole and is divided into twenty-four geographical time areas according to the local time, wherein said geographical time areas are colour coded such that each adjacent area differs in colour;

(iii) a first time zone identifier defined by a circle located on said frame and substantially concentric with said map, said first time zone identifier being substantially evenly divided into twenty-four segments marked with your indications as for a calibrated twenty-four hour clock scale; and (iv) a second time zone identifier defined by an annular band located around the perimeter of said rotatable circular map, said second time zone identifier being evenly divided into twenty-four segments distinguished by a different adjacent colour, wherein every said second time zone segment is associated with a proximate geographical time area having the same colour;

whereby aligning a second time zone segment associated to said selected geographical area to a first time zone segment according to the known local time of said selected geographical area, the actual local hour of said any location in the world can be identified by reading the hour indication on the first time zone identifier which is adjacent to a second time zone segment associated with said any location in the world.

2. A device as claimed in claim 1 comprising a twenty-four-hour clock mechanism, including hour, minute and second hands, whereby said clock mechanism is operatively connected to said map such that said map is caused to rotate at a rate corresponding to the rotation of said hour hand.

3. A device as claimed in claim 1 wherein said map further comprises coding means for geographical areas located in half hour time zones, said coding means including additional hached lines, wherein said half hour time zones' time is one half hour behind the time identified on said first time zone segment.

4. A device as claimed in claim 2 wherein said map further comprises coding means for geographical areas located in half hour time zones, said coding means including additional hached lines, wherein said half hour time zones' time is one half hour behind the time identified on said first time zone segment.

5. A device as claimed in claim 1, wherein said adjacent colour segments of said second time zone identifier are disposed approximately adjacent to said world map and wherein said world map, including said south pole projection, further comprises a world map extending to at least approximately the 90° latitude.

* * * * *